United States Patent [19]

Ginzburg

[11] Patent Number: 4,730,475

[45] Date of Patent: Mar. 15, 1988

[54] ROLLING MILL METHOD

[75] Inventor: Vladimir B. Ginzburg, Pittsburgh, Pa.

[73] Assignees: International Rolling Mills Consultants, Inc.; United Engineering Rolling Mills, Inc., both of Pittsburgh, Pa.

[21] Appl. No.: 860,054

[22] Filed: May 6, 1986

[51] Int. Cl.[4] ..... B21B 1/02; B21B 31/18

[52] U.S. Cl. ..... 72/234; 72/199; 72/229; 72/247; 72/366

[58] Field of Search ..... 72/247, 245, 243, 241, 72/237, 199, 20, 21, 234, 226, 240, 229, 365, 366

[56] References Cited

U.S. PATENT DOCUMENTS

| | | | |
|---|---|---|---|
| 3,857,268 | 12/1974 | Kajiwaka | 72/247 |
| 4,238,946 | 12/1980 | Tsubota | 72/199 |
| 4,392,371 | 7/1983 | Okumura et al. | 72/231 |

FOREIGN PATENT DOCUMENTS

| | | | |
|---|---|---|---|
| 0106604 | 8/1980 | Japan | 72/240 |
| 0052504 | 3/1982 | Japan | 72/234 |
| 58-53304 | 3/1983 | Japan . | |
| 0221601 | 12/1983 | Japan | 72/199 |
| 0113904 | 6/1984 | Japan | 72/234 |
| 59-110401 | 6/1984 | Japan . | |
| 0209409 | 11/1984 | Japan | 72/199 |
| 0137505 | 7/1985 | Japan | 72/234 |

*Primary Examiner*—Robert L. Spruill

*Assistant Examiner*—Steve Katz

*Attorney, Agent, or Firm*—Arnold B. Silverman

[57] ABSTRACT

A metal workpiece such as a slab is rolled into a desired width without requiring broadsiding. The system generally involves reducing a first portion along the width of the workpiece to a first thickness while creating a second portion along the width of the workpiece having a thickness greater than the first portion thickness and having a predetermined mass. Subsequently the second portion is reduced to establish a predetermined increase in the width of the workpiece and a decrease in the thickness of the workpiece to obtain a substantially uniform thickness along substantially the entire width of the workpiece. A preferred approach includes providing a pair of cooperating work rolls at least one of which has a generally cylindrical portion and at least one adjacent tapered portion. Initial reduction is effected by employing a pair of cooperating cylindrical central portions and at least one tapered portion. This provides a workpiece with a reduced portion and an enlarged portion. The workpiece subsequently may be rotated 180 degrees or side shifted and rolled between a generally cylindrical central portion and a second pair of tapered portions. Subsequently, further reduction may be effected solely between a pair of central portions. Relative axial movement of one work roll with respect to another may be employed in effecting sequential spreading of the workpiece.

14 Claims, 16 Drawing Figures

ROLLING MILL METHOD

BACKGROUND OF THE INVENTION

1. Field Of The Invention

The present invention relates to a method and apparatus for rolling a metal workpiece by means of work rolls having a cylindrical portion and a tapered portion.

2. Description of The Prior Art

It has been known to provide a workpiece of given width by longitudinal slitting of the edges. This, however, can produce substantial scrap.

It has also been known in connection with the rolling of metal slabs to provide an initial profile from the sizing pass wherein the central portion of the slab is of reduced thickness with respect to the generally transversely outwardly diverging lateral portions thereof. Subsequently, the workpiece is rotated 90 degrees and is run through a rolling mill stand which provides a generally uniform thickness to the workpiece. The workpiece is subsequently rotated 90 degrees in the opposite direction from the initial rotation and further rolling is effected so as to provide a workpiece of desired uniform thickness. This practice is known as "broadsiding". See generally U.S. Pat. Nos. 4,238,946 and 4,392,371. One of the difficulties with this practice is the need to effect two 90 degree rotations of the workpiece.

U.S. Pat. No. 3,857,268 discloses axially shiftable tapered work rolls employed to accommodate varying workpiece width and improve flatness control; See also Japan No. 59-110401 and Japan No. 58-53384. These approaches do not employ the method for spreading the workpiece.

In spite of these known practices, there remains a need for a more efficient, more direct method and associated apparatus for effecting rolling of a plate of a desired thickness.

SUMMARY OF THE PRESENT INVENTION

The present invention has met the above-described need by providing in one embodiment a method of rolling metal wherein a rolling mill has a pair of cooperating work rolls having a generally cylindrical central portion and at least one adjacent tapered portion. An initial reduction of the workpiece is effected between a pair of cylindrical portions and a first pair of tapered portions. A second reduction is effected between a pair of cylindrical portions and a second pair of tapered portion disposed on the other side of the cylindrical portions. Intermediate reductions may be effected, if desired. Subsequently, a further reduction is effected solely on a pair of said cylindrical portions. In general, these reductions will be effected on separate roll stands as by sequentially in a tandem mill, for example.

It is an object of the present invention to provide an efficient means of rolling a metal slab to the desired uniform thickness and width without requiring the use of broadsiding.

It is a further object of the present invention to provide such a method and apparatus which employ tapered roll work surfaces to alternately cooperate with cylindrical central work surface portions in effecting intermediate stages of rolling a slab into a transfer bar of desired thickness.

It is a further object of the present invention to provide an economical and efficient means for converting a slab into a metal plate of desired thickness.

It is a further object of this invention to provide a workpiece of desired width and thickness without requiring edge slitting or broadsiding.

These and other objects of the present invention will be more fully understood from the following description of the invention on reference to the illustrations appended hereto.

DESCRIPTION OF THE PREFERRED EMBODIMENT

Figure 1:
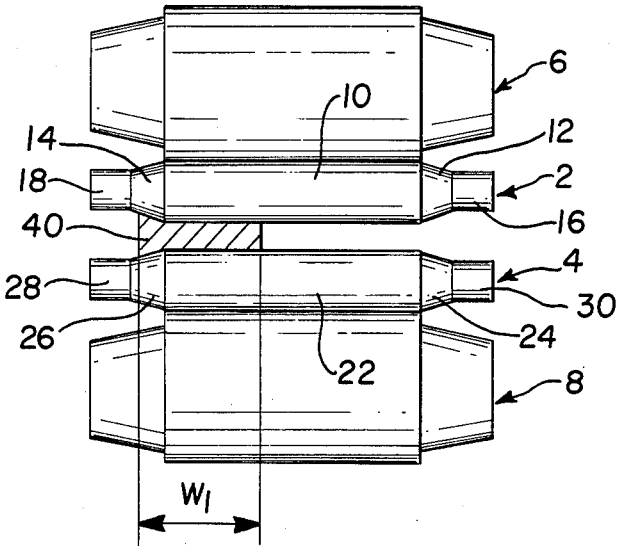
FIG. 1 is a schematic illustration of a mill stand of the present invention showing the workpiece being reduced by a first portion of the work rolls.

Referring now more specifically to FIG. 1, there is shown a pair of work rolls 2, 4 and a pair of associated cooperating backup rolls 6, 8. Work roll 2 has a generally centrally disposed, generally cylindrical portion in surface-to-surface contact with a corresponding portion of backup roll 6. Disposed adjacent to and laterally of the central portion 10 are a pair of tapered portions 12, 14 which extend toward the respective roll necks 16, 18 and converge inwardly toward the respective ends of roll 2. Similarly, roll 4 has a generally centrally disposed generally cylindrical portion 22, a pair of adjacent tapered portions 24, 26 which extend generally in the direction of the roll necks 28, 30 and converge inwardly toward the respective ends of roll 4. It will be appreciated that tapered portions 14, 26 provide a first cooperative pair of roll end sections and tapered portions 12, 24 provide a second cooperative pair of roll end sections disposed on the opposite side of said central portions 10, 22 from said first cooperative pair of roll end sections. Cylindrical portion 22 is in surface-to-surface contact with backup roll 8. Workpiece 40 which may be assumed to have had an initial with $W_0$ has been enlarged in width to a width $W_1$ and has a generally rectangular portion and an adjacent tapered portion.

Figure 2:
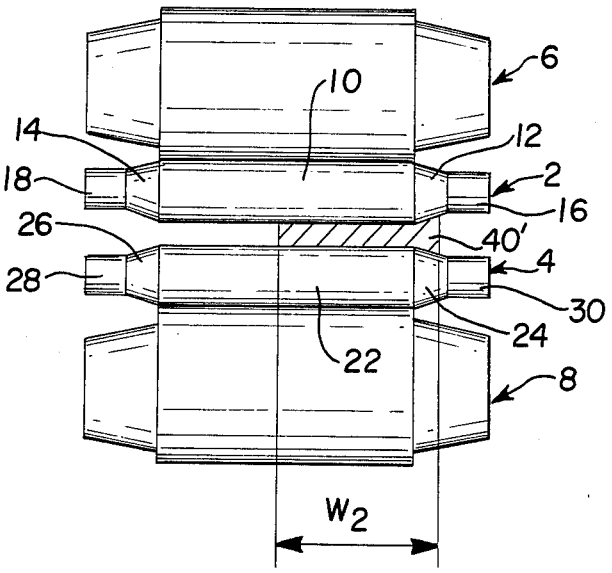
FIG. 2 is a schematic illustration of a rolling mill of the present invention reducing a workpiece using a different portion of the work roll surfaces.

Referring to FIG. 2, there is shown a second pass in which like numbers have been employed for like parts as compared with FIG. 1. The workpiece 40 has been either rotated 180 degrees or side shifted such that the side of the workpiece near its opposite edge is in contact with tapered portions 12, 24, rather than tapered portions 14, 26 as was the case in connection with the initial reduction shown in FIG. 1. The roll gap in FIG. 2 is reduced with respect to that of FIG. 1 and a second reduction has been effected in the workpiece which is indicated as beeing 40' having a width $W_2$ which is greater than width $W_1$.

Figure 3:
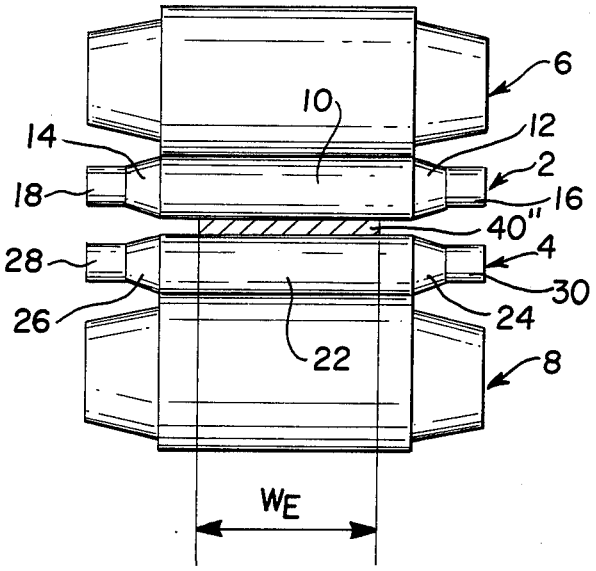
FIG. 3 is a schematic illustration of a rolling mill stand of the present invention wherein the workpiece is rolled by the cylindrical work roll surfaces.

FIG. 3 shows the final pass wherein the reduction is preferably effected solely between cylindrical work surfaces 10, 22 and the workpiece 40'' has a generally rectangular configuration. It will be appreciated, that in this manner, the slab which had an initial width $W_0$ has been widened to the desired width $W_E$ and has been reduced to the desired uniform thickness. All of this has been accomplished while taking advantage of the benefit of employing tapered lateral edges during the rolling process without requiring burdensome broadsiding of the workpiece.

Figure 4:
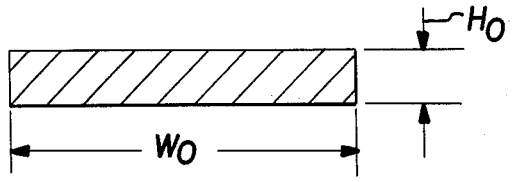
FIG. 4 is a cross-sectional illustration of a slab prior to rolling in the system of the present invention.

Referring to FIGS. 4 through 7 an additional feature of the present invention will be considered. FIG. 4 shows a metal slab having an initial thickness $H_o$ and an initial width $W_o$. In this embodiment of the invention it is contemplated that there will be relative axial shifting of the rolls so that the cylindrical portions will not be aligned. The rolls may be generally of the type illustrated in FIGS. 1 through 3 wherein a cylindrical portion on each roll has at least one portion adjacent thereto which tapers generally toward the roll end and will preferably have two such adjacent tapered portions.

Figure 5:
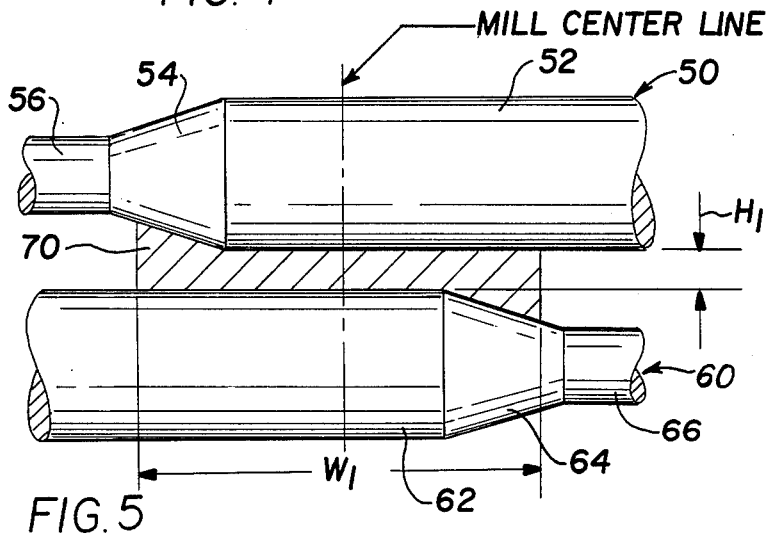
FIG. 5 is a schematic illustration of an initial reduction stage.

In FIG. 5 there is shown a roll 50 having a cylindrical portion 52, an adjacent tapered portion 54 and a roll neck 56. A similar tapered portion and roll neck (not shown) may be provided at the other end of the roll. Similarly, roll 60 has a cylindrical portion 62, a tapered portion 64 and a roll neck 66. This roll 60 may also have a second tapered portion and roll neck (not shown). It will be appreciated that both of the rolls have been set in relative position through axial movement of one or both rolls such that the rolls are offset with respect to the center line of the mill stand. Roll 50 is offset to the right as viewed in FIG. 5 and roll 60 is offset to the left as viewed in FIG. 5. This results in a segment of the cylindrical surfaces 52, 62 working on workpiece 70, one edge portion of the workpiece 70 being rolled between cylindrical surface 62 and tapered surface 54 and the other edge portion of the workpiece 70 being rolled between cylindrical surface 52 and tapered surface 64. The workpiece 70, therefore, has generally outwardly tapered portions at both longitudinal edges and has a thickness adjacent to the cylindrical portion of the roll equal to $H_1$ and a workpiece width $W_1$.

Figure 6:
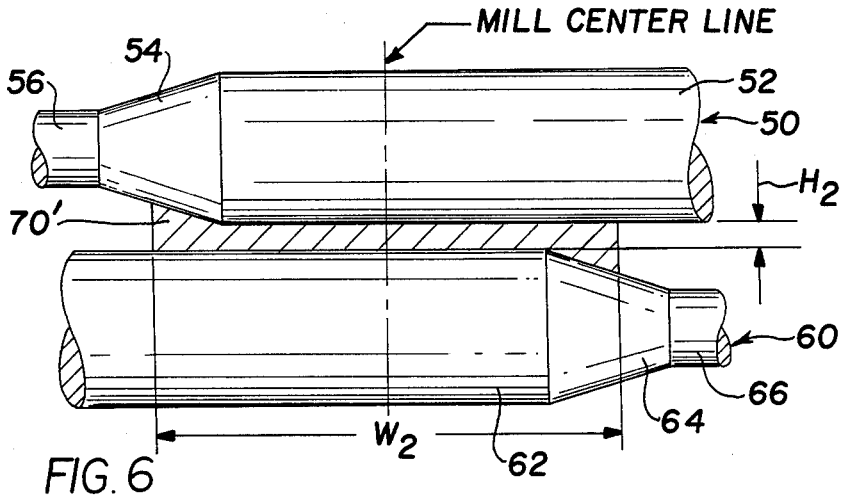
FIG. 6 is a schematic illustration of a second reduction stage.

As is shown in FIG. 6, roll 50 has been shifted axially toward the left by a predetermined distance and roll 60 has been shifted to the right by a predetermined distance. The cylindrical portions have greater contact with the workpiece than in FIG. 5. The workpiece 70' has a mean height or thickness $H_2$ which is less than $H_1$ and a width $W_2$ which is greater than width $W_1$.

Figure 7:
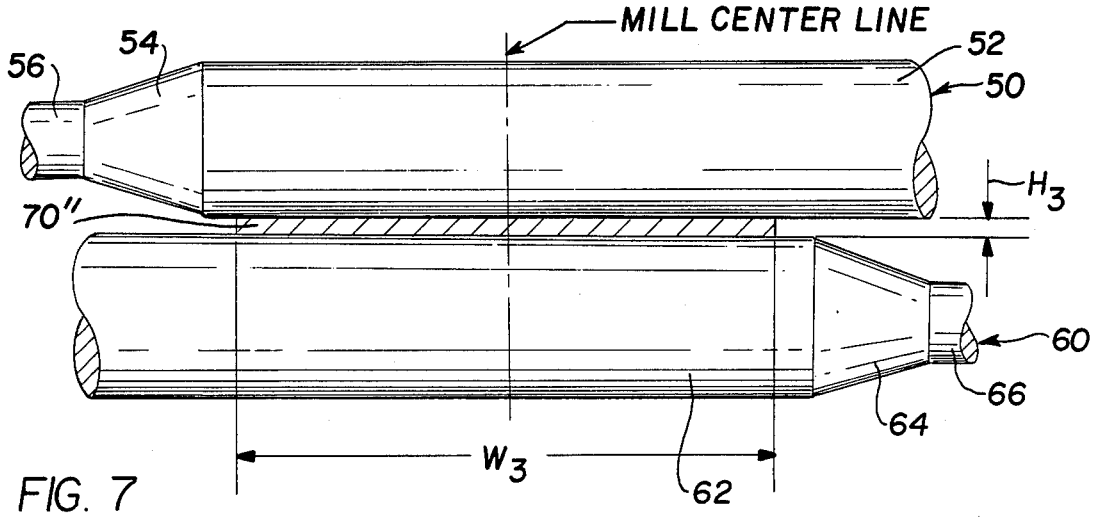
FIG. 7 is a schematic illustration of a further reduction stage.

FIG. 7 shows the effect of continued relative axial shifting of the rolls with roll 50 having been moved farther to the left and roll 60 having been moved farther to the right. In this further rolling the thickness or height $H_3$ is less than $H_2$ and width $W_3$ is greater than width $W_2$. It will be appreciated tha the entire workpiece 70'' is being rolled between cylindrical surfaces 52, 62.

It will be appreciated that the method and apparatus of FIGS. 1 through 7 may be employed in a single stand reversing mill or in a multistand mill. It will further be appreciated than in the method and apparatus of FIGS. 4 through 7, the edges of the workpiece rather than being rolled between a pair of aligned tapered portions are in the initial and second reduction stages being rolled between one tapered roll surface and a cylindrical roll surface.

Figure 8:
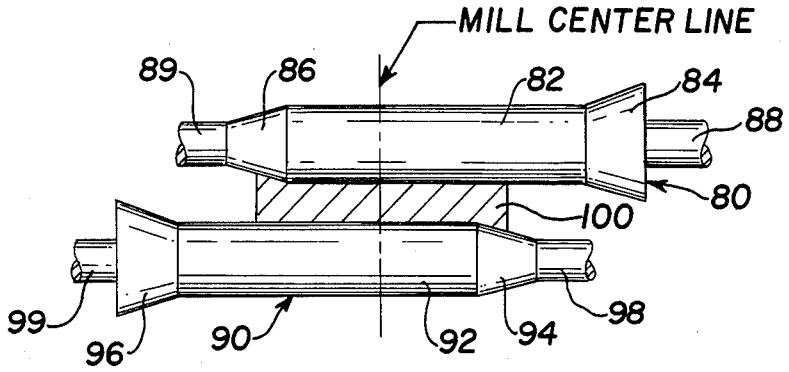
FIGS. 8 and 9 show modified forms of rolls usable in the present invention.
Figure 9:
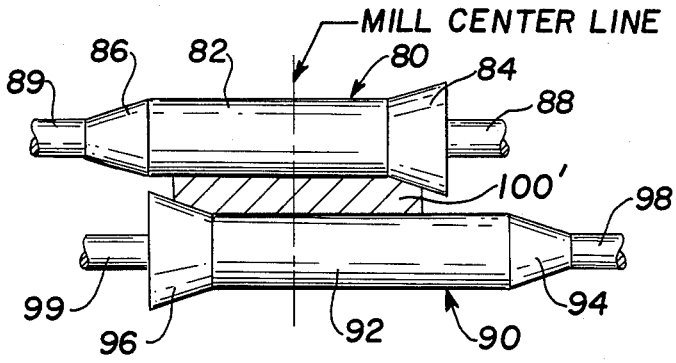
Figure 10:
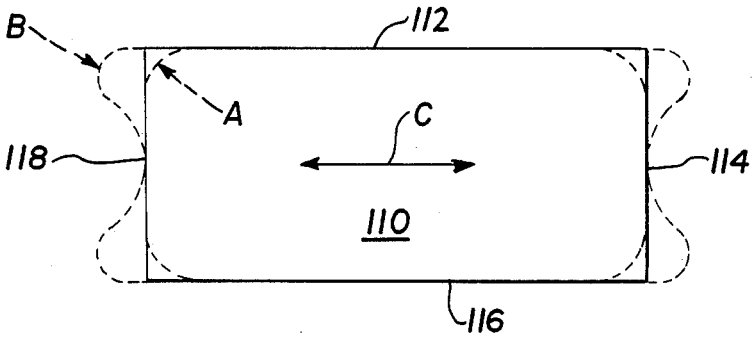
FIG. 10 illustrates a plan view of a slab.

Referring now in greater details to FIGS. 8 through 10, a further embodiment of the invention will be considered. In this embodiment, each of the rolls 80, 90, respectively, has cylindrical sections 82, 92, converging tapered portions 86, 94 and diverging tapered portion 84, 96. Roll 80 has roll necks 88, 89 disposed axially outwardly of the tapered portions 84, 86, respectively, and roll 90 has roll necks 98, 99 disposed axially outwardly of the tapered portions 94, 96. It is noted that rolls 80, 90 are positioned relative to each other such that outwardly converging tapered portion 86 is disposed at the same end as outwardly diverging tapered portion 96 and outwardly diverging tapered portion 84 is disposed at the same end as outwardly converging tapered portion 94. Workpiece 100 as shown in FIG. 8 is being rolled between cylindrical surfaces 82, 92 with one edge being rolled between tapered surface 86 and cylindrical surface 92 and the other edge being rolled between tapered surface 94 and cylindrical surface 82. The workpiece 100 has both longitudinal edges enlarged with respect to the center portion.

In the position shown in FIG. 9, roll 80 has been shifted to the left axially and roll 92 has been shifted to the right axially. As a result, workpiece 100' is being rolled between cylindrical surfaces 82, 92 and one edge is being rolled between tapered portion 96 and cylindrical portion 82 while the other edge is being rolled between tapered portion 84 and cylindrical surface 92. In this manner, workpiece 100' is provided with outwardly converging longitudinal edges.

Referring to FIG. 10, there is shown a plan view of a slab which is being rolled in a reversing mill in the direction shown by arrow C. The slab 110 has longitudinal edges 112, 116 and transverse edges 114, 118. When the workpiece 100 is in contact with the outwardly converging tapered portions 86, 94 and the associated rolls cylindrical surfaces 82, 92 the slab length near the longitudinal edges 112, 116 will tend to be shorter and assume the contour indicated by the letter A. When the workpiece is in contact with the outwardly diverging tapered portions 84, 96 and the associated cylindrical portions 82, 92, the slab length near the longitudinal edges 112, 116 will tend to be elongated and assume the contour shown by letter B. By balancing these two concepts, the desired slab shape is achieved without requiring broadsiding and while minimizing undesired scrap loss. A square edged plate may be created in this manner without shearing of the ends.

Figure 11:
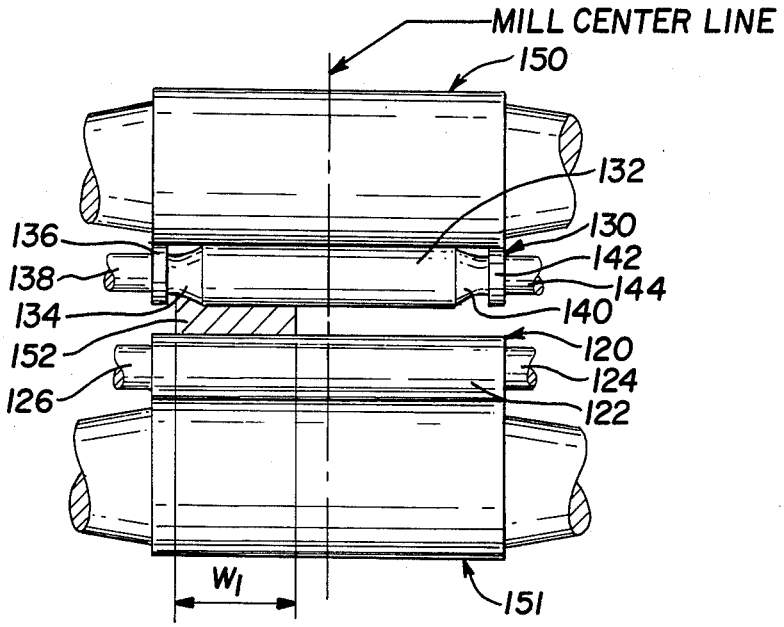
FIG. 11 illustrates a further embodiment of the invention wherein tapered surfaces appear on only one roll.

Referring to FIG. 11, there is shown a further embodiment of the invention wherein a cylindrical roll 120 cooperates with a roll 130. The cylindrical roll 120 has a cylindrical surface 122 and a pair of roll necks 124, 126. The other roll 130 has a central cylindrical section 132, a first adjacent outwardly converging tapered section 134, a cylindrical portion 136 and a roll neck 138. Roll 130 also has a second outwardly converging tapered section 140 disposed adjacent to cylindrical section 132, and a cylindrical surface 142 and a roll neck 144. A pair of backup rolls 150, 151 are shown in operative surface-to-surface contact, respectively, with respect to cylindrical sections 132, 136, 142 and 122 of the rolls 130, 120. Workpiece 152 is being rolled with one portion being disposed between cylindrical surfaces 122 and 132 and one edge which diverges generally upwardly being rolled between cylindrical surface 122 and tapered surface 134.

Figure 12:
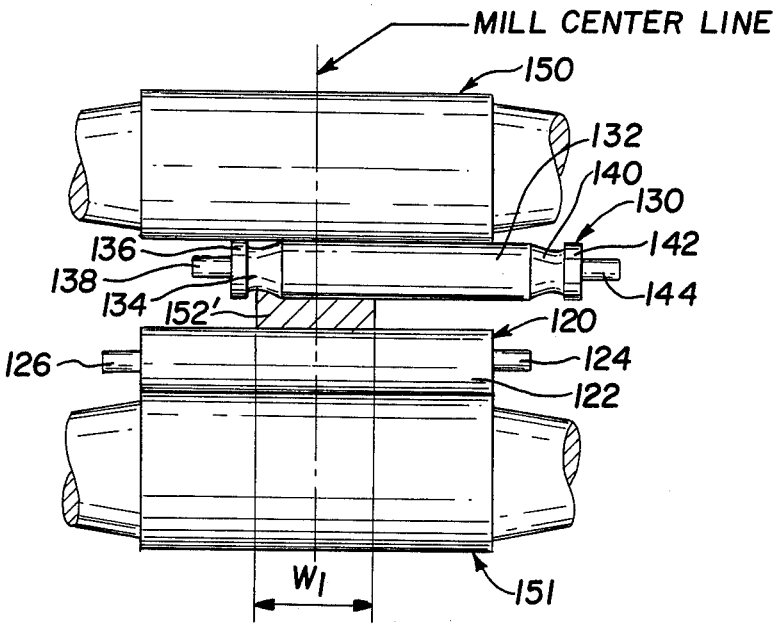
FIG. 12 illustrates the apparatus of FIG. 11 with the work rolls shifted.

FIG. 12 shows rolls similar to those of FIG. 11 but shows roll 130 being relatively moved with respect to roll 120 so as to provide workpiece 152' with a contour substantially identical to workpiece 152 of FIG. 11, both of which have a width $W_1$.

Figure 13:
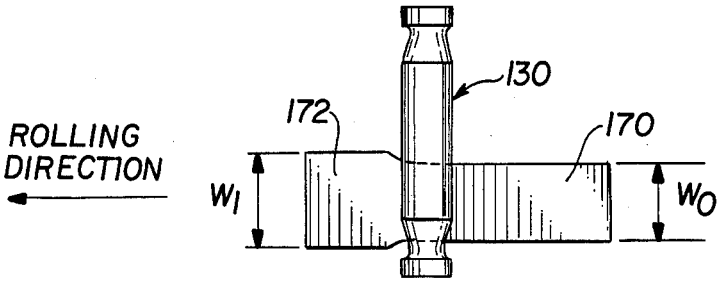
FIGS. 13 through 15 illustrate stages of spread rolling in a reversing mill.
Figure 14:
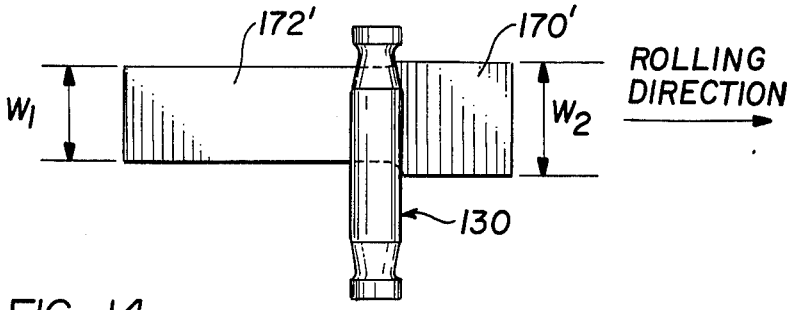
Figure 15:
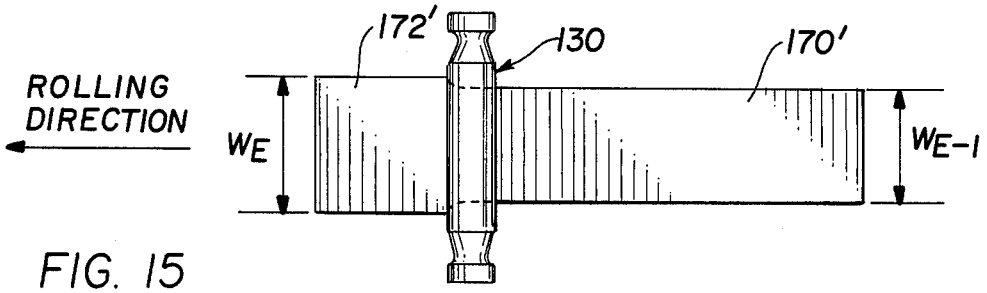

FIGS. 13 through 15 illustrate a reversing mill employing the concept of FIGS. 11 and 12 wherein relative side shifting either of the workpiece or of the two work rolls is provided. As is shown in FIG. 13, the initial workpiece 170 has a width $W_0$ and is being rolled adjacent to a first end of roll 130 (with the other rolls not being shown). The workpiece 172 has been spread to a width $W_1$ and has a reduced thickness with respect to workpiece 170.

Referring to FIG. 14, the mill is reversed and the workpiece rolled adjacent to the second end of roll 130. The workpiece moving in the direction indicated is subjected to a spreading from a width $W_1$ to a greater width $W_2$. With or without intermediate rolling stages, the further and final rolling stage shows the workpiece moving from right to left in FIG. 15 and going from a width $W_{E-1}$ to a width $W_E$. It will be appreciated that in FIGS. 13 and 14 first one edge of the strip is being rolled both by the tapered and cylindrical surfaces and the cooperation between a first tapered surface and a cylindrical surface and then the other edge is rolled by the cooperating cylindrical surfaces and the other tapered surface cooperating with a cylindrical surface. In the final pass shown in FIG. 15, two cylindrical surfaces do the rolling.

Figure 16:
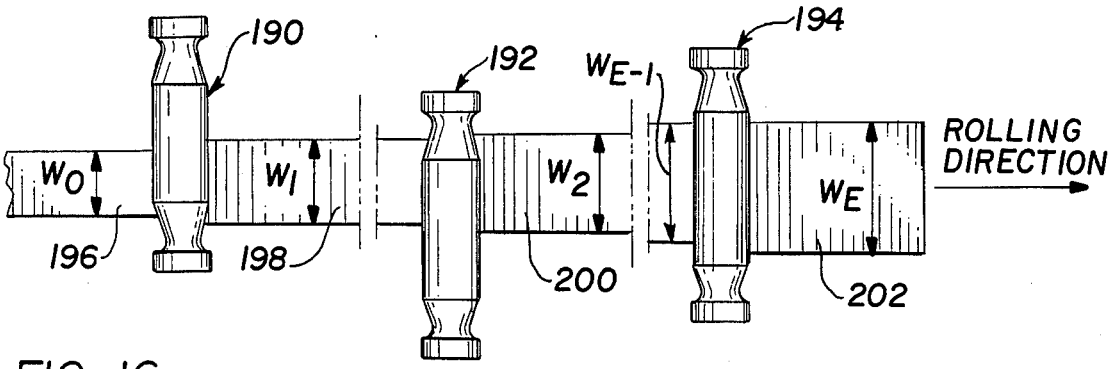
FIG. 16 illustrates stages of spread in a multistand mill.

Referring to FIG. 16, there is shown a multistand mill wherein rolls having a central cylindrical portion and a pair of adjacent outwardly converging tapered portions act on the workpiece to provide initial rolling by one cylindrical portion and one tapered portion with a pair of cooperating cylindrical surfaces on one edge and then a second reduction stage employing the other tapered surface in cooperation with a cylindrical surface and a pair of cylindrical surfaces with the final reduction being effected solely between two cooperating cylindrical surfaces. In FIG. 16, initial reduction is effected by roll 190 on workpiece 196 having a width $W_0$ with the emerging product 198 having a reduced thickness and increased with $W_1$. The second reduction is effected by roll 192 which spreads or widens the workpiece 200 having an increased width $W_2$ and a reduced thickness with respect to workpiece 198. With or without intermediate stages the final reduction is effected by roll 194 wherein cooperating cylindrical surfaces spread the workpiece 202 to a width $W_E$ and reduced thickness.

In general, it is preferred that with respect to the tapered surfaces of the work rolls of the present invention the tangent of the angle of taper be greater than the coefficient of friction between the roll and the material.

It will be appreciated that while the illustrations have in some instances shown work rolls of the invention used in two high mills and in four high mills, the invention is not so limited.

It will be appreciated that in the broader aspects of the invention an initial reduction preferably involves reducing a first portion along the width of the workpiece to a first thickness while creating a second width portion having a thickness greater than said first portion thickness and having a predetermined mass. Thereafter, a subsequent workpiece reduction involves reducing said second portion to cause a predetermined increase in the width of the workpiece and a decrease in the thickness thereof to the extent of obtaining a substantially uniform thickness along substantially the entire width of said workpiece.

It will be appreciated, therefore, that the method and apparatus of the present invention have provided an effective means for providing the desired reduction in a workpiece to achieve the predetermined thickness and width without requiring scrap creating edge slitting and also without requiring broadsiding. All of this is accomplished by sequential rolling at least some of which involves rolling of a portion of the workpiece in contact with a tapered work roll surface disposed adjacent to a cylindrical work surface.

Whereas particular embodiments of the invention has been described above for purposes of illustration, it will be appreciated by those skilled in the art that numerous variations of the details may be made without departing from the invention as described in the appended claims.

I claim:

1. A method of rolling a metal workpiece by a series of successive reducing passes, the passes being formed by one or more pairs of cooperative rotating work rolls, said pairs of work having cooperative reducing center and cooperative reducing first and second end sections, the latter for alternately rolling one or more portions of the workpiece, with each said first end section of said rolls being on the same side of said center sections as the other said first end sections and each said second end section of said rolls being on the same side of said center sections as the other said second end sections, the steps comprising:

(a) reducing by a said pair of cooperative center roll sections in a first pass a first portion of the workpiece while forming by a said first cooperative pair of roll end sections on a second portion of the workpiece a thickness greater than said reduced first portion of a predetermined mass, (b) prior to the next succeeding pass positioning the workpiece and a pair of said rolls relative to each other so one of said portions of the workpiece can be rolled by a second said cooperative pair of roll end sections, and thereafter, (c) in a first succeeding pass reducing one of said first or said second portions by a said cooperative pair of said center roll sections, while forming by a second cooperative pair of roll end sections on the other of said first or said second portions a thickness greater than said twice reduced center portion of a predetermined mass, and (d) in a further succeeding pass reducing all previously rolled portions of the workpiece by a said cooperative pair of center roll sections to establish a predetermined increase in the width of the workpiece and a decrease in the thickness of said workpiece to the extent of obtaining a substantially uniform thickness along substantially the entire width of the workpiece.

2. The method of rolling a metal workpiece of claim 1 wherein in said first succeeding pass reducing said second portion by said second cooperative pari of roll end sections to a thickness greater than said first portion.

3. The method of claim 2 including
effecting each said reduction on a separate mill stand.

4. The method of claim 2 including
effecting each said reduction on a single mill stand.

5. The method of rolling a metal workpiece of claim 4 including
effecting said first succeeding reduction with said workpiece rotated 180 degrees with respect to the position of said workpiece in said initial reduction.

6. The method of rolling a metal workpiece of claim 4 including
effecting said first succeeding reduction after side shifting said workpiece.

7. The method of rolling a metal workpiece of claim 4 including
effecting intermediate reductions between said first succeeding reduction and said further succeeding reduction.

8. The method of rolling a metal workpiece of claim 1 including
subsequent to said first succeeding reduction pass effecting said further succeeding reduction solely with a pair of said cylindrical sections.

9. The method of rolling a metal workpiece of claim 8 including
effecting said intial reduction on a metal slab.

10. The method of rolling a metal workpiece of claim 8 including
effecting each said reduction without broadsiding said workpiece.

11. The method of rolling a metal workpiece of claim 1 including
providing said cooperative work rolls having said cooperative reducing center section of generally cylindrical configuration and said cooperative reducing end sections of tapered configuration,
effecting the initial reduction of said workpiece between (a) a pair of said cylindrical center sections and (b) a pair of said tapered end sections, and
effecting said further succeeding reduction pass between said cylindrical center sections.

12. A method of rolling a metal workpiece having a center portion and opposite side portions by a series of successive reducing passes, the passes being formed by one or more pairs of cooperative rotating work rolls, said pairs of work rolls having cooperative reducing center and cooperative reducing end sections, the latter for alternately rolling both side portions of the workpiece, the steps comprising:

(a) reducing by a said pair of cooperative center roll sections in a first pass the center portion of the workpiece while forming by said center roll sections and a cooperative pair of roll end sections on said side portions of the workpiece a thickness greater than said reduced center portion of a predetermined mass, (b) prior to the next succeeding pass positioning the workpiece and a pair of said rolls relative to each other so that both said side portions of the workpiece can be rolled by a second said cooperative pair of roll end sections, and thereafter, (c) in a succeeding pass reducing again said center portion by a said cooperative pair of said center roll sections, while reducing by said center roll sections and a second cooperative pair of roll end sections said side portions to a thickness less than said twice reduced center portion, (d) in a further succeeding pass reducing all previously rolled portions of the workpiece by a said cooperative pair of center roll sections to establish a predetermined increase in the width of the workpiece and a decrease in the thickness of said workpiece to the extent of obtaining a substantially uniform thickness along substantially the entire width of the workpiece, providing each said roll with two tapered reducing end sections with one said tapered section converging generally outwardly and the other said tapered section diverging generally outwardly, and positioning said rolls with one said roll having the diverging taper at the end where the other said roll has the converging taper.

13. The method of rolling a metal workpiece of claim 12 including
effecting said initial reduction between said generally cylindrical surfaces and between said converging tapered sections of one said roll and said generally cylindrical surfaces of the other said roll.

14. The method of rolling a metal workpiece of claim 13 including
after said initial reduction but prior to said further succeeding reduction effecting a final succeeding reduction,
effecting said first succeeding reduction between said generally cylindrical sections and between said diverging tapered sections of one said roll and said generally cylindrical sections of the other said roll.

* * * * *

UNITED STATES PATENT AND TRADEMARK OFFICE

CERTIFICATE OF CORRECTION

PATENT NO. : 4,730,475

DATED : March 15, 1988

INVENTOR(S) : VLADIMIR B. GINZBURG

It is certified that error appears in the above-identified patent and that said Letters Patent is hereby corrected as shown below:

Column 3, line 7, "beeing" should be --being--.

Column 3, line 66, "tha" should be --that--.

Claim 1, column 6, line 30, --rolls-- should be inserted after "work".

Claim 2, column 6, line 68, "pari" should be --pair--.

Signed and Sealed this

Eighteenth Day of October, 1988

*Attest:*

*Attesting Officer*

DONALD J. QUIGG

*Commissioner of Patents and Trademarks*